US011548761B2

(12) United States Patent
Oggianu et al.

(10) Patent No.: US 11,548,761 B2
(45) Date of Patent: Jan. 10, 2023

(54) DETECTING ELEVATOR MECHANICS IN ELEVATOR SYSTEMS

(71) Applicant: OTIS ELEVATOR COMPANY, Farmington, CT (US)

(72) Inventors: Stella M. Oggianu, Farmington, CT (US); Ankit Anand Gupta, Mysuru (IN); Tadeusz Pawel Witczak, Farmington, CT (US); Craig Drew Bogli, Avon, CT (US); Vineet Srivastava, Mysuru (IN)

(73) Assignee: OTIS ELEVATOR COMPANY, Farmington, CT (US)

( * ) Notice: Subject to any disclaimer, the term of this patent is extended or adjusted under 35 U.S.C. 154(b) by 763 days.

(21) Appl. No.: 16/520,755

(22) Filed: Jul. 24, 2019

(65) Prior Publication Data

US 2020/0039784 A1 Feb. 6, 2020

(30) Foreign Application Priority Data

Jul. 31, 2018 (IN) ..... 201811028705

(51) Int. Cl.

| | |
|---|---|
| ***B66B 5/00*** | (2006.01) |
| ***B66B 1/28*** | (2006.01) |
| ***B66B 3/00*** | (2006.01) |
| ***B66B 5/02*** | (2006.01) |

(52) U.S. Cl.

CPC ..... *B66B 5/005* (2013.01); *B66B 1/28* (2013.01); *B66B 3/002* (2013.01); *B66B 5/025* (2013.01)

(58) Field of Classification Search

CPC ... B66B 1/3492; B66B 5/0031; B66B 5/0087; B66B 5/0025; B66B 1/3446; B66B 3/02; B66B 5/0012; B66B 5/0006; B66B 5/005; B66B 5/00

See application file for complete search history.

(56) References Cited

U.S. PATENT DOCUMENTS

| | | | | |
|---|---|---|---|---|
| 5,933,082 | A | 8/1999 | Abita et al. | |
| 6,202,797 | B1 * | 3/2001 | Skolnick | B66B 5/005 187/391 |
| 7,083,027 | B2 | 8/2006 | Siikonen et al. | |
| 7,327,251 | B2 | 2/2008 | Corbett, Jr. | |

(Continued)

FOREIGN PATENT DOCUMENTS

| | | |
|---|---|---|
| CN | 1286207 A | 3/2001 |
| CN | 1342129 A | 3/2002 |

(Continued)

OTHER PUBLICATIONS

European Search Report; European Application No. 19189439.3; Filed: Jul. 31, 2019; dated Mar. 20, 2020; 7 pages.

*Primary Examiner* — Marlon T Fletcher

(74) *Attorney, Agent, or Firm* — Cantor Colburn LLP

(57) ABSTRACT

Embodiments include a method and system for detecting mechanics in an elevator system. The system includes a controller configured to communicate with one or more anchors, and a tag configured to transmit a signal, wherein the signal includes an identifier and location information. The system also includes one or more anchors, wherein the one or more anchors are configured to detect the signal from the tag, wherein the controller is configured to execute a safety action response to detecting the signal from the tag.

20 Claims, 4 Drawing Sheets

(56) References Cited

U.S. PATENT DOCUMENTS

| | | | | |
|---|---|---|---|---|
| 7,600,613 | B2 | 10/2009 | Kang et al. | |
| 7,737,850 | B2 | 6/2010 | Malik | |
| 7,868,760 | B2 | 1/2011 | Smith et al. | |
| 3,061,486 | A1 | 11/2011 | Monzon et al. | |
| 8,556,043 | B2 * | 10/2013 | Mangini | B66B 5/0043 187/392 |
| 9,359,171 | B1 * | 6/2016 | Nowel | A42B 3/0453 |
| 9,810,767 | B1 * | 11/2017 | Hamilton | G01S 5/0242 |
| 10,906,776 | B2 * | 2/2021 | Nanjappan | B66B 5/005 |
| 2008/0084317 | A1 | 4/2008 | Gakhar et al. | |
| 2012/0013453 | A1 | 1/2012 | Wyne et al. | |
| 2017/2451047 | | 8/2017 | Klimek et al. | |
| 2019/0062106 | A1 * | 2/2019 | Ginsberg | B66B 1/40 |
| 2020/0039784 | A1 * | 2/2020 | Oggianu | B66B 5/005 |

FOREIGN PATENT DOCUMENTS

| | | | | | |
|---|---|---|---|---|---|
| CN | 1434784 | A | | 8/2003 | |
| CN | 103278798 | | | 9/2013 | |
| CN | 105678351 | A1 | | 6/2016 | |
| CN | 107682807 | A | | 2/2018 | |
| CN | 105947823 | B | * | 8/2018 | B66B 5/0006 |
| DE | 102013001987 | A1 | | 8/2014 | |
| DE | 102016202364 | A1 | * | 8/2017 | B60L 13/06 |
| EP | 1314678 | B1 | | 10/2005 | |
| EP | 3354612 | A1 | | 8/2018 | |
| EP | 3450375 | A1 | | 3/2019 | |
| EP | 3640184 | A1 | | 4/2020 | |
| FI | 121663 | B | * | 10/2009 | |
| GB | 2473061 | A | | 3/2011 | |
| JP | 02169482 | A | | 6/1990 | |
| JP | H0413000 | A | | 1/1992 | |
| JP | 2005132543 | A | | 5/2005 | |
| JP | 2006139380 | A | | 6/2006 | |
| JP | 2014133619 | A | | 7/2014 | |
| WO | 2008082380 | A1 | | 7/2008 | |
| WO | 2014095511 | A1 | | 6/2014 | |
| WO | WO-2014095511 | A1 | * | 6/2014 | F16P 3/147 |
| WO | WO-2014115402 | A1 | * | 7/2014 | B66B 1/3492 |
| WO | WO-2015040734 | A1 | * | 3/2015 | B66B 1/3492 |
| WO | WO-2017085238 | A1 | * | 5/2017 | B66B 1/3492 |
| WO | WO-2018015171 | A1 | * | 1/2018 | |

* cited by examiner

DETECTING ELEVATOR MECHANICS IN ELEVATOR SYSTEMS

CROSS-REFERENCED TO RELATE APPLICATIONS

This application claims the benefit of Indian Application No. 201811028705 filed Jul. 31, 2018, which is incorporated herein by reference in its entirety.

BACKGROUND

The embodiments herein relate to sensors, and more specifically, to sensors for detecting elevator mechanics in elevator systems.

Elevator mechanics perform service and repairs to ensure the proper functioning of the elevator systems. In some instances, the mechanics must gain access to the hoistway of the elevator system to perform maintenance where they are exposed to various cables, beams, structures, and other moving parts. In order to ensure the safety of the mechanics in the hoistway, effective safety measures are needed to detect the presence of a mechanic and perform a responsive action for their protection.

BRIEF SUMMARY

According to an embodiment, a method for detecting mechanics in a system is provided. The method includes monitoring a zone using one or more anchors. The method also includes detecting a location of a tag in the zone, and executing a safety action based at least in part on the location of the tag.

In addition to one or more of the features described herein, or as an alternative, further embodiments include calibrating one or more anchors in the system, wherein the anchors are positioned in a hoistway of an elevator system, wherein the one or more anchors monitor at least one of an area above an elevator car or an elevator pit.

In addition to one or more of the features described herein, or as an alternative, further embodiments include configuring a master anchor to communicate with other anchors and a controller, wherein the master anchor is selected based on at least one of a static assignment or a dynamic assignment, wherein the dynamic assignment is based on at least one of a battery life, functionality, or power ON sequence of the one or more anchors.

In addition to one or more of the features described herein, or as an alternative, further embodiments include safety actions such as activating an alarm system, activating the elevator safety chain and processes, sending an alarm, disabling an elevator car, reducing elevator car speed, or restricting access to one or more floors.

In addition to one or more of the features described herein, or as an alternative, further embodiments include transmitting an alarm to at least one of a user device or a system.

In addition to one or more of the features described herein, or as an alternative, further embodiments include a tag that is an ultra-wide band (UWB) RF tag.

In addition to one or more of the features described herein, or as an alternative, further embodiments include executing a safety action on an adjacent elevator car based at least in part on the location of the tag.

In addition to one or more of the features described herein, or as an alternative, further embodiments include performing a first safety action based at least in part on the detection of the tag in a first sub-zone of the area of an elevator car.

In addition to one or more of the features described herein, or as an alternative, further embodiments include performing a second safety action based at least in part on the detection of the tag in a second sub-zone of the area of the elevator car, wherein the first safety action is different from the second safety action.

In addition to one or more of the features described herein, or as an alternative, further embodiments include detecting multiple tags having a unique identifier.

In another embodiment, a system for detecting mechanics is provided. The system includes a controller configured to communicate with one or more anchors, and a tag configured to communicate with other tags and the anchor, and transmit a signal, wherein the signal includes identifier and location information. The system also includes one or more anchors, wherein the one or more anchors are configured to detect the signal from the tag, wherein the controller is configured to execute a safety action response to detecting the signal from the tag.

In addition to one or more of the features described herein, or as an alternative, further embodiments include an anchor that is configured as a master anchor.

In addition to one or more of the features described herein, or as an alternative, further embodiments include a tag that is an ultra-wide band (UWB) RF tag.

In addition to one or more of the features described herein, or as an alternative, further embodiments include anchors that are positioned in a hoistway of an elevator system to monitor at least one of an area above one or more elevator cars or an elevator pit.

In addition to one or more of the features described herein, or as an alternative, further embodiments include anchors that are configured to perform a calibration which includes configuring a master anchor to communicate with other anchors and the controller, wherein the master anchor is selected based on at least one of a static assignment or a dynamic assignment, where the dynamic assignment is based on at least one of a battery life, functionality, or power ON sequence of the one or more anchors.

In addition to one or more of the features described herein, or as an alternative, further embodiments include executing safety actions such as disabling an elevator car, reducing elevator car speed, or restricting access to one or more floors.

In addition to one or more of the features described herein, or as an alternative, further embodiments include a controller that is configured to transmit an alarm to at least one of a user device or an external system.

In addition to one or more of the features described herein, or as an alternative, further embodiments include a controller that is configured to execute a safety action on an adjacent elevator car based at least in part on the location of the tag.

In addition to one or more of the features described herein, or as an alternative, further embodiments include a controller that is configured to perform a first safety action based at least in part on the detection of the tag in a first sub-zone of the area of an elevator car, and perform a second safety action based at least in part on the detection of the tag in a second sub-zone of the area of the elevator car, wherein the first safety action is different from the second safety action.

In addition to one or more of the features described herein, or as an alternative, further embodiments include a plurality of tags, wherein each tag of the plurality of tags includes a unique identifier.

Technical effects of embodiments of the present disclosure include detecting the precise location of the mechanic using robust sensor technology to prevent any potential risks or provide an alarm to the mechanic to ensure their safety.

The foregoing features and elements may be combined in various combinations without exclusivity, unless expressly indicated otherwise. These features and elements as well as the operation thereof will become more apparent in light of the following description and the accompanying drawings. It should be understood, however, that the following description and drawings are intended to be illustrative and explanatory in nature and non-limiting.

BRIEF DESCRIPTION OF THE DRAWINGS

The present disclosure is illustrated by way of example and not limited in the accompanying figures in which like reference numerals indicate similar elements.

DETAILED DESCRIPTION

Elevator hoistways may be equipped with various types of sensors and cameras to detect the presence of mechanics and other personnel. However, current solutions using cameras may suffer from low lighting conditions inhibiting the ability to positively detect a person in the area. Other sensors and detectors may be affected by the dust build up on the equipment which can interfere with their performance Other sensors and detectors may be limited by their directional zone of coverage and they may also be limited by the structures enclosing the area.

In one or more embodiments, tags such as ultra-wide band (UWB) RF (hereinafter referred to as UWB tag) are used to determine a precise location of a mechanic. It is to be understood that other types of wireless technology can be used in association with the tags. The UWB tag offers a number of added benefits over the conventional techniques. The UWB tag is configured to sweep several different frequencies and is not limited to a single frequency. The UWB tag offers a robust solution with low interference to other signals and objects within a zone of coverage. In addition, the UWB tag is able to transmit signals and beacons beyond a confined space and can be detected through walls and other structures. In addition, the techniques described herein provide a solution that can be quickly installed and retrofit on existing elevator configurations to enhance the safety features of the system. The techniques described herein not only detect the presence of a mechanic but determine the location of the mechanic. In addition, the techniques described herein are not solely limited to UWB technology but can also be applied to other wired and wireless technologies.

Figure 1:
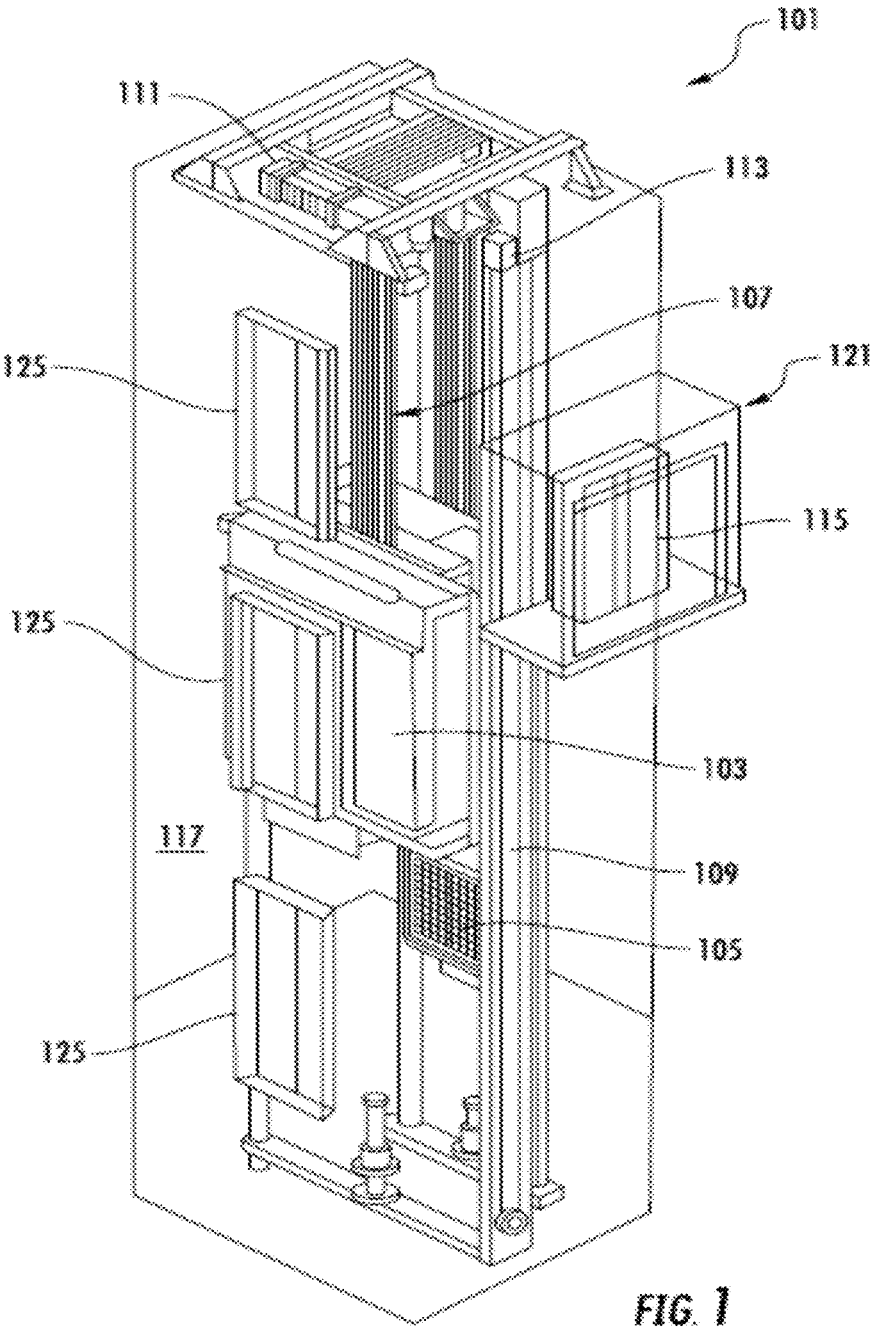
FIG. 1 depicts a schematic illustration of an elevator system that may employ various embodiments of the present disclosure.

FIG. 1 is a perspective view of an elevator system 101 including an elevator car 103, a counterweight 105, a tension member 107, a guide rail 109, a machine 111, a position reference system 113, and a controller 115. The elevator car 103 and counterweight 105 are connected to each other by the tension member 107. The tension member 107 may include or be configured as, for example, ropes, steel cables, and/or coated-steel belts. The counterweight 105 is configured to balance a load of the elevator car 103 and is configured to facilitate movement of the elevator car 103 concurrently and in an opposite direction with respect to the counterweight 105 within an elevator shaft 117 and along the guide rail 109.

The tension member 107 engages the machine 111, which is part of an overhead structure of the elevator system 101. The machine 111 is configured to control movement between the elevator car 103 and the counterweight 105. The position reference system 113 may be mounted on a fixed part at the top of the elevator shaft 117, such as on a support or guide rail, and may be configured to provide position signals related to a position of the elevator car 103 within the elevator shaft 117. In other embodiments, the position reference system 113 may be directly mounted to a moving component of the machine 111, or may be located in other positions and/or configurations as known in the art. The position reference system 113 can be any device or mechanism for monitoring a position of an elevator car and/or counter weight, as known in the art. For example, without limitation, the position reference system 113 can be an encoder, sensor, or other system and can include velocity sensing, absolute position sensing, etc., as will be appreciated by those of skill in the art.

The controller 115 is located, as shown, in a controller room 121 of the elevator shaft 117 and is configured to control the operation of the elevator system 101, and particularly the elevator car 103. For example, the controller 115 may provide drive signals to the machine 111 to control the acceleration, deceleration, leveling, stopping, etc. of the elevator car 103. The controller 115 may also be configured to receive position signals from the position reference system 113 or any other desired position reference device. When moving up or down within the elevator shaft 117 along guide rail 109, the elevator car 103 may stop at one or more landings 125 as controlled by the controller 115. Although shown in a controller room 121, those of skill in the art will appreciate that the controller 115 can be located and/or configured in other locations or positions within the elevator system 101. In one embodiment, the controller may be located remotely or in the cloud.

The machine 111 may include a motor or similar driving mechanism. In accordance with embodiments of the disclosure, the machine 111 is configured to include an electrically driven motor. The power supply for the motor may be any power source, including a power grid, which, in combination with other components, is supplied to the motor. The machine 111 may include a traction sheave that imparts force to tension member 107 to move the elevator car 103 within elevator shaft 117.

Although shown and described with a roping system including tension member 107, elevator systems that employ other methods and mechanisms of moving an elevator car within an elevator shaft may employ embodiments of the present disclosure. For example, embodiments may be employed in ropeless elevator systems using a linear motor to impart motion to an elevator car. Embodiments may also be employed in ropeless elevator systems using a hydraulic lift to impart motion to an elevator car. FIG. 1 is merely a non-limiting example presented for illustrative and explanatory purposes.

In other embodiments, the system comprises a conveyance system that moves passengers between floors and/or along a single floor. Such conveyance systems may include escalators, people movers, etc. Accordingly, embodiments described herein are not limited to elevator systems, such as that shown in FIG. 1.

Figure 2:
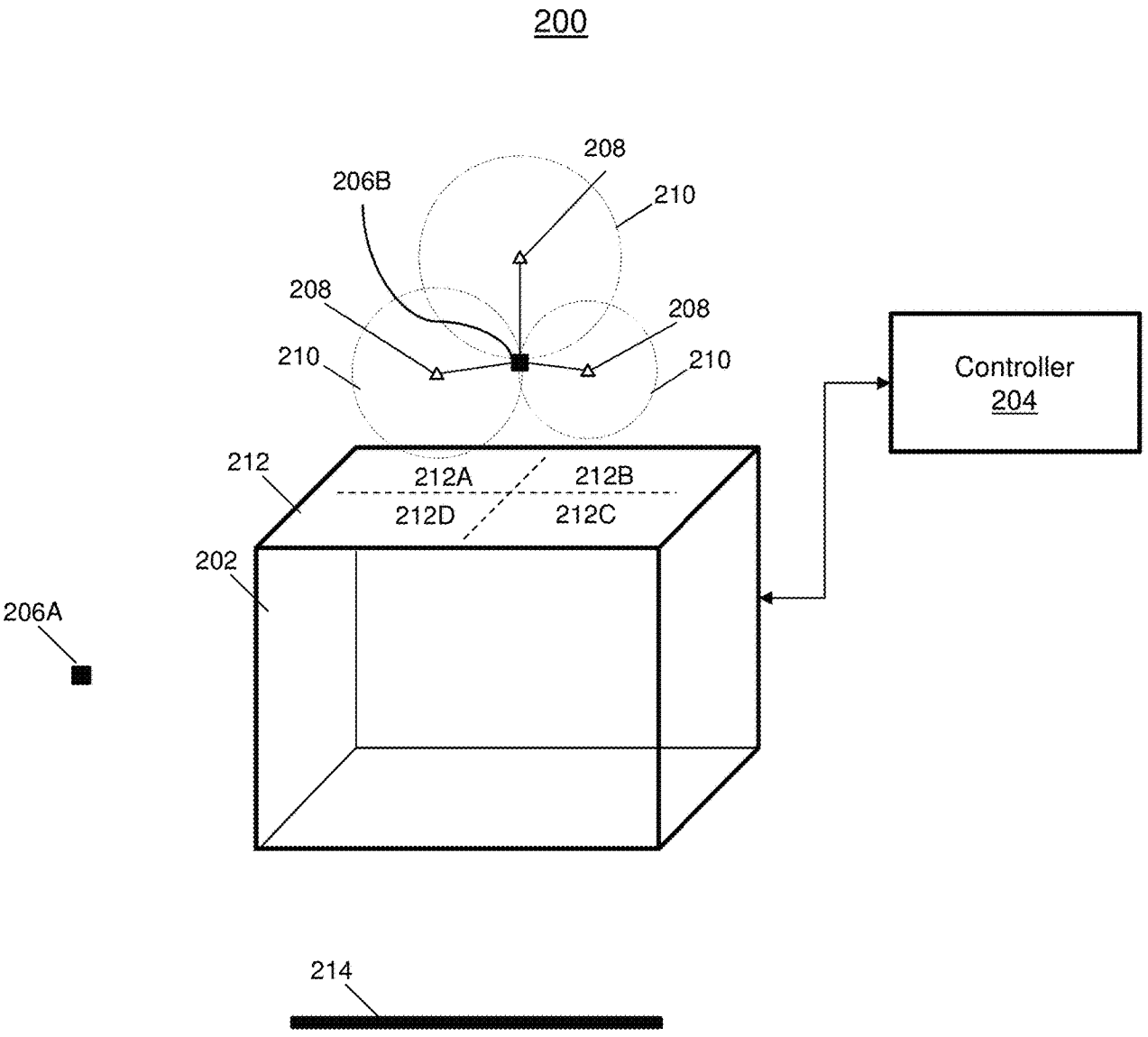
FIG. 2 depicts an elevator system in accordance with one or more embodiments.

In FIG. 2, a system 200 for performing mechanic detection in accordance with one or more embodiments is shown. The system 200 includes an elevator car 202 which can include one or more components of the elevator system 101 shown in FIG. 1. The elevator car 202 is coupled to a controller 204 that is configured to communicate with and control the elevator car 202 by exchanging commands/signals. In some embodiments, the controller 204 is an elevator controller 204 that is configured to control the operation of one or more elevator cars 202. Also shown in FIG. 2 are tags 206A, 206B configured to communicate with anchors 208. The tags 206 and anchors 208 are both configured for bidirectional communication for distance/ranging protocols where the anchors 208 as shown have a zone of coverage 210. In one or more embodiments, the tags 206 are battery powered. In one or more embodiments, the tag 206 can be incorporated in the clothing or equipment of the person or object to be detected. This includes glasses, watches, phones, safety helmets, etc. It should be understood the tag can be appended to any item and/or location for detection. The tags 206A and 206B can be UWB tags and the anchors 208 can be configured to detect the transmitted signals. In this non-limiting example, the tag 206A is located outside of the hoistway and the tag 206B is located on top of the elevator car 202. In another example, the anchors 208 can be used to determine whether the mechanic is working in an adjacent hoistway and further determine whether a safety action is needed based on the precise location of the mechanic. In one or more embodiments, the tag(s) 206 and anchors 208 can operate independently of the elevator controller (204) to detect and track the tag(s) 206.

The anchors 208 are configured to receive and detect signals/beacons that are transmitted from the tags 206. In some embodiments, the anchors 208 are battery powered anchors and in other embodiments, the anchors can be directly coupled to a power source such as an AC power source. In other embodiments, the anchors can be operably coupled to the elevator car or a controller. In the example configuration shown in FIG. 2, three anchors 208 are shown to monitor the top portion of the elevator 202. The combination of anchors 208 is configured to perform trilateration to determine the location of the tag 206B which is detected on top of the elevator car 202. In one or more embodiments, the trilateration is performed from at least three beacon signals from the anchors. Additionally, the trilateration can be performed in an anchor, external processing system, controller, in any other local or remote computing device. The location data of the tag 206 can include an x, y, z coordinate information, radial location information, or any other type of coordinate information that can be used to provide a location data of the tag 206. The anchors 208 are capable of determining that the tag 206A is not located in the hoistway and therefore, that no safety action needs to be performed. Although it is shown that the anchors 208 are configured to monitor the top 212 of an elevator car 202, the anchors can also be configured to monitor the elevator pit 214 or floor, or any other desired location where an operator may be exposed to a risk of injury such as a machine room.

In one or more embodiments, a master anchor is configured to collect data from the other anchors. The data includes detection information of the tag 206. Each tag 206 can be configured with a unique identifier to allow the location of multiple mechanics to be monitored by the anchors 208. The master anchor can be configured to perform the calculation to determine the location of the one or more tags. The master anchor can also be configured to communicate with other anchors, a controller, user device, etc. The master anchor can include the same design as the other anchors or include a different specialized design for increased functionality, such as increased computing power to perform calculations on the received signals to determine the location of the tag. In one or more embodiments, the data can be provided to a controller or some other local device to perform the calculation. In a different embodiment, the calculation can be performed by processing device in the network cloud. In other embodiments, the calculations can be embedded locally in one or more of the anchors such as the master anchor.

The master anchor can be configured in a static or dynamic fashion. A master anchor can be statically selected by pre-configuring the master anchor among the plurality of anchors. The master anchor can be dynamically selected based on the remaining battery life of each of the plurality of anchors or the first anchor to be powered ON. In addition, the master anchor can be selected based on the functionality of each anchor. It should be understood the master anchor can be selected by other techniques.

In other embodiments, the functionality of the master anchor can be distributed among the plurality of anchors. For example, a first anchor can be configured to communicate with a user device, such as for a mechanic A second anchor can be configured to communicate with a controller. Another anchor can be configured to collect the data from the other anchors. It should be understood that these functions and/or other additional functions can be performed by any combination of anchors.

The plurality of anchors 208 can be configured to detect a subzone of an area such as the top portion of the elevator 202. The top portion 212 of the elevator in this non-limiting example is divided into four subzones 212A-D. The plurality of anchors can detect the zone tag 206 is present and also detect the exact location within the subzone the tag 206 is located. In this non-limiting example, the tag 206B is detected in the subzone 212A. This zone or the precise location can be used to determine which safety action is to be performed. Although only four subzones 212A-D are shown, the anchors 208 are capable of supporting more or fewer subzones including subzones in the pit 214 or any other desired monitoring area.

In some embodiments, the area above and/or below the elevator car 202 can be divided into subzones, such as subzones 212A-D, where a detection in each subzone can trigger a different safety action to be performed based on the level of risk associated with each subzone. For example, in a multi-car elevator system having a first elevator hoistway that is adjacent to a second elevator hoistway, such as that shown in FIG. 3, the area above the top of each elevator car can be divided into multiple subzones. In the event a mechanic is detected in a subzone of the first elevator that is not adjacent to a subzone in the second elevator, a safety action or safety measure can be implemented to reduce the speed of the second elevator when it comes in close proximity, such as one or two floors away, to the location of the detected mechanic. In another example, the second elevator can be stopped and the floors where the mechanic is working on the first elevator can be restricted to the second elevator.

On the other hand, if the mechanic is detected in the zone of the first elevator that is adjacent to a zone in the second elevator, the second elevator can be immediately stopped for the safety of the mechanic. In a different example, the adjacent elevator can be configured to operate normally if a mechanic in a non-adjacent zone and slowed down if the mechanic is detected in an adjacent zone. It should be understood that other configurations can be used.

In one or more embodiments, the location of the tag can be monitored as a mechanic wearing the tag approaches the hoistway and a corresponding safety action can be taken based on the location/distance relative to the hoistway the mechanic is in. For example, as a mechanic approaches the hoistway and upon detection of the tag, a notification can be transmitted to the mechanic, such as to a mobile device or an audio/visual indication provided outside of the hoistway. As the mechanic gets closer to the hoistway an alert can be transmitted to the mechanic. As the mechanic enters the hoistway and the precise location is determined an alarm or other indication can be provided to the mechanic. It should be understood the notifications can also be transmitted to a controller and further transmitted to another device or system for further processing. This configuration provides escalating an alert level as the mechanic approaches and enters the hoistway to ensure the mechanic is aware of his presence in a particular safety zone.

In one or more embodiments, the safety action can include disabling the elevator car 202. In other embodiments, the elevator car 202 can be slowed down or restricted from accessing a certain number of floors. Other actions can be taken such as temporarily delaying the operation of an elevator car 202. The delay can be a pre-configured delay or the presence can be detected again to determine whether it is safe to operate the elevator car 202. It is to be understood that the tag and anchor(s) can perform the detection and tracking independently of the elevator system. Also, the results of the detection and tracking can be used for a number of applications and is not limited by those disclosed in association with the elevator system. In one or more embodiments, a master anchor can be configured as a controller and operated to manage the tags and anchors independently of the elevator system.

Figure 3:
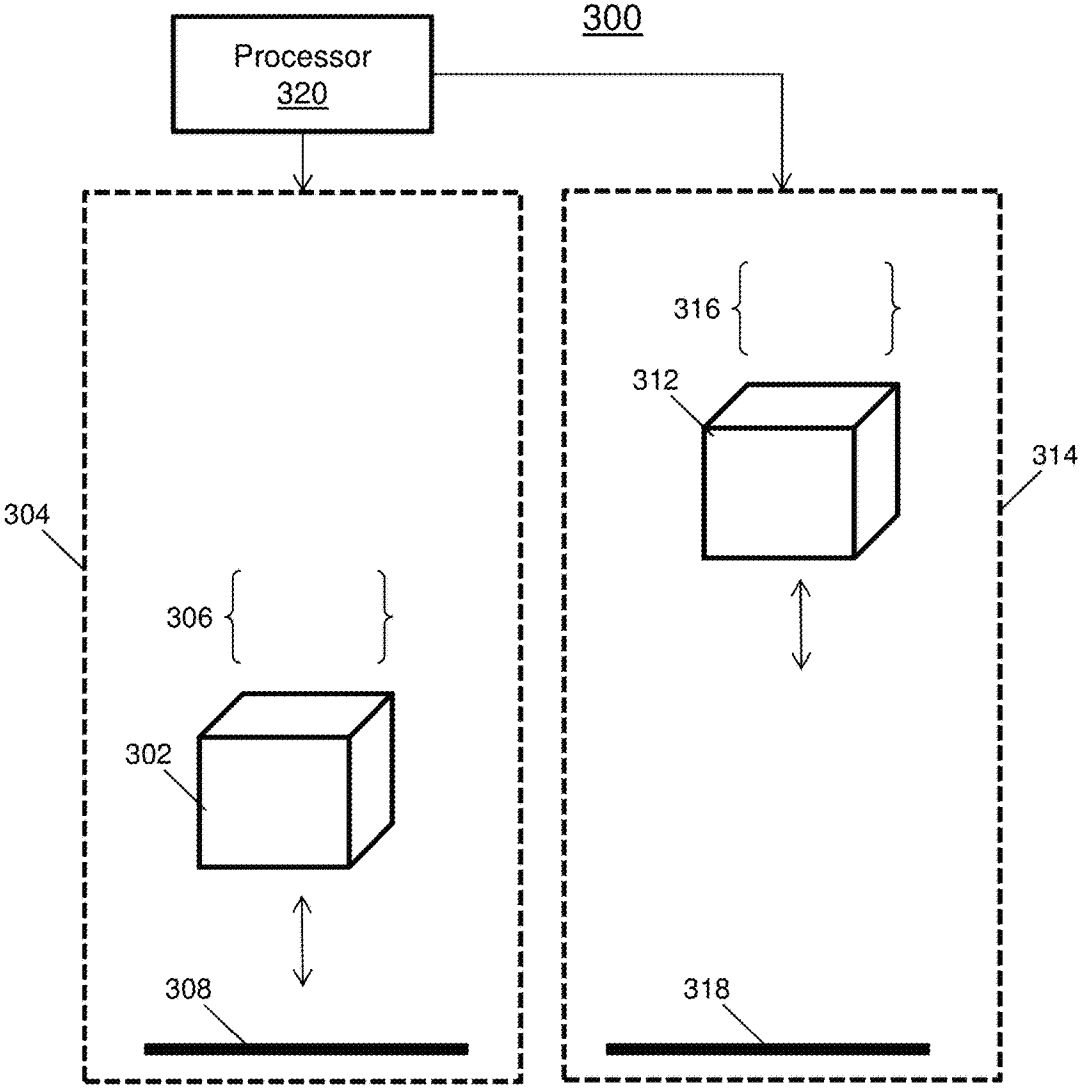
FIG. 3 depicts a multi-elevator system in accordance with one or more embodiments.

In FIG. 3, a multi-elevator car system 300 in accordance with one or more embodiments is shown. The multi-elevator system 300 includes a first elevator car 302 in a first hoistway 304 that is adjacent to a second elevator car 312 in a second hoistway 314. The first and second elevator cars 302, 312 as shown are coupled to a controller 320. In a different embodiment, separate controllers are used to control the first and second elevator cars 302, 312. It should be understood that although only two elevator cars are shown any number and configuration of elevator cars can be used. The first and second elevator hoistways 304, 314 can be configured with multiple anchors (not shown) to monitor the areas above 306, 316 and/or below 308, 318 the elevator cars 302, 312. In a non-limiting example, if a mechanic wearing a tag is detected on top of the first elevator car 302 in a subzone nearest the second elevator car 312, a safety action may require the second elevator car 312 to be stopped. However, if the tag is detected on the side furthest from the second elevator car 312, the second elevator car 312 may remain operational or may operate at a reduced speed. In another scenario, the anchors (not shown) of the first elevator car 302 responsive to detecting a tag in the second elevator hoistway 314 can take safety actions to ensure the safety of the mechanic wearing the detected tag in the first elevator hoistway 304.

Figure 4:
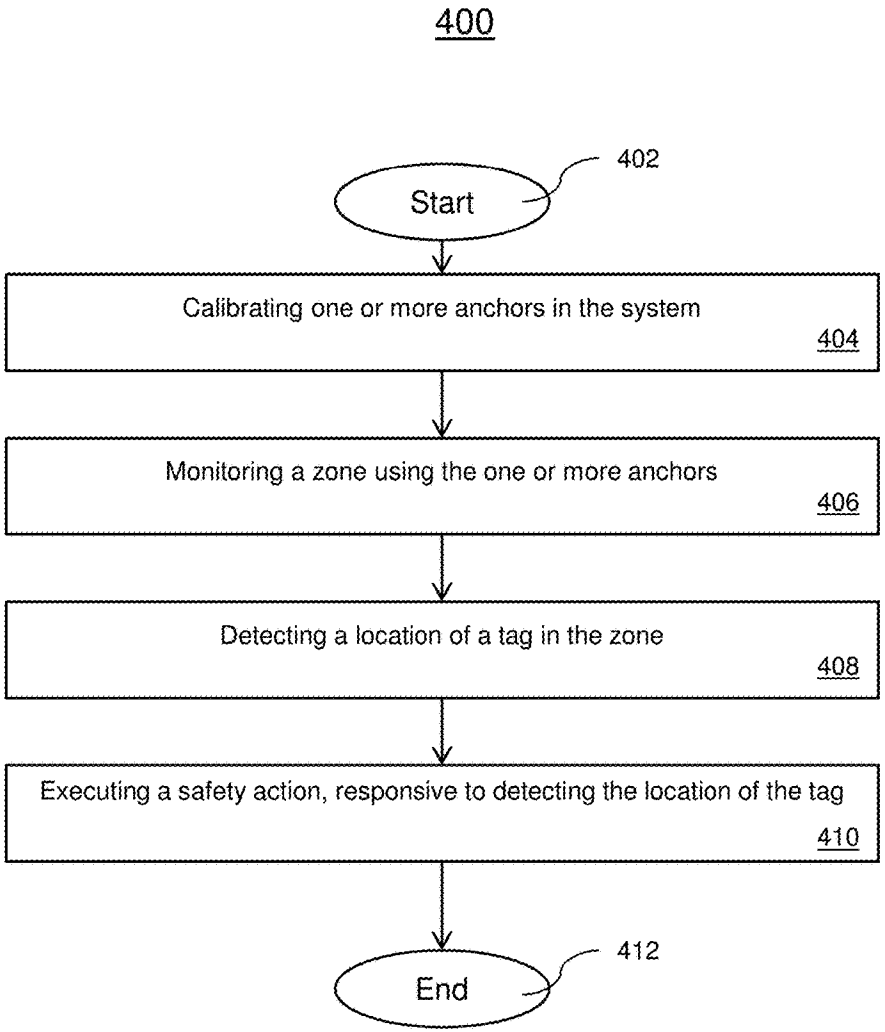
FIG. 4 depicts a flowchart of a method for performing elevator mechanic detection in a system in accordance with one or more embodiments.

Now referring to FIG. 4, a flowchart of a method 400 for performing elevator mechanic detection in an elevator system in accordance with one or more embodiments is shown. The method 400 begins at block 402 and proceeds to block 404 which provides for calibrating one or more anchors. The calibration includes determining a master anchor that is configured as the master anchor. In one or more embodiments, during a calibration phase the plurality of anchors are configured to exchange signals to perform an automatic referencing process among the anchors. The signals can include time information and signal strength information which can be used to determine the relative location of the anchors. In addition, the signals can include battery strength information where the anchor with the highest battery capacity is configured as the master anchor. The position of the anchors defines the zone of detection. The plurality of anchors can be located in the hoistway to monitor an area above the elevator car or in the elevator pit. It should be understood the anchors can be positioned in other areas that are desired to be monitored.

The method 400, at block 406 provides for monitoring a zone using the one or more anchors. The anchors are configured to determine when a tag has entered the area. In other embodiments, each tag is configured with an identifier and the anchors can detect and track multiple tags (mechanics) in a location simultaneously.

At block 408 the method 400 includes detecting a location of a tag in the zone. In one or more embodiments, the data is collected from the plurality of anchors to determine a location of the tag. The data can include performing trilateration techniques using the plurality of sensors to determine the location of the tag such as the x, y, z, coordinates of the tag. The location information can also be indicated in the form of a timestamp and signal strength. In one or more embodiments, the anchors are configured to exchange tag information among the anchors. For example, the anchors are configured to share tag distance information with other tags.

The method 400 proceeds to block 410 which provides for executing a safety action, responsive to detecting the location of the tag. In one or more embodiments, the safety action can include disabling an elevator car such as opening the safety chain. In another example, the operating speed of the elevator car can be reduced. In a different example, the access to a number of floors can be restricted based on the detection. In other embodiments, the anchors can track the movement of the tag independent of performing a safety action on the elevator system.

The method 400 can be repeated at a configurable interval or can be triggered by an initial detection of the tag by at least one of the anchors. In one or more embodiments, the anchors can be configured to operate in a low power, low frequency listen-only mode until a tag is detected. The method 400 ends at block 412. Although the detectors are discussed in reference to UWB transmitters/receivers, it should be understood that the UWB transmitters/receives can be coupled with other types of technologies for communication, detectors, and sensors in the system to implement safety measures for the mechanics present in a monitored location.

The technical benefits and effects include improved safety for elevator service mechanics. The accurate position information reduces the triggering of false alarms based on a mechanic standing next to a designated safety area or working on an adjacent elevator in a multi-unit system. The technical benefits and effects improve over simply detecting if a user is present but determines an exact location to select a safety measure to implement. The tags offer a high data rate in short range, non-interfering, and high multi-path immunity configuration that improves over the current systems.

As described above, embodiments can be in the form of processor-implemented processes and devices for practicing those processes, such as a processor. Embodiments can also be in the form of computer program code containing instructions embodied in tangible media, such as network cloud storage, SD cards, flash drives, floppy diskettes, CD ROMs, hard drives, or any other computer-readable storage medium, wherein, when the computer program code is loaded into and executed by a computer, the computer becomes a device for practicing the embodiments. Embodiments can also be in the form of computer program code, for example, whether stored in a storage medium, loaded into and/or executed by a computer, or transmitted over some transmission medium, loaded into and/or executed by a computer, or transmitted over some transmission medium, such as over electrical wiring or cabling, through fiber optics, or via electromagnetic radiation, wherein, when the computer program code is loaded into an executed by a computer, the computer becomes a device for practicing the embodiments. When implemented on a general-purpose microprocessor, the computer program code segments configure the microprocessor to create specific logic circuits.

The term "about" is intended to include the degree of error associated with measurement of the particular quantity and/or manufacturing tolerances based upon the equipment available at the time of filing the application.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

Those of skill in the art will appreciate that various example embodiments are shown and described herein, each having certain features in the particular embodiments, but the present disclosure is not thus limited. Rather, the present disclosure can be modified to incorporate any number of variations, alterations, substitutions, combinations, subcombinations, or equivalent arrangements not heretofore described, but which are commensurate with the scope of the present disclosure. Additionally, while various embodiments of the present disclosure have been described, it is to be understood that aspects of the present disclosure may include only some of the described embodiments. Accordingly, the present disclosure is not to be seen as limited by the foregoing description but is only limited by the scope of the appended claims.

What is claimed is:

1. A method for detecting a tag in a system, the method comprising:

monitoring a zone using one or more anchors;

wherein the one or more anchors comprise a master anchor and other anchors;

wherein the master anchor is operable to collect data from the other anchors;

detecting, using the master anchor, a location of a tag in the zone;

tracking the location of the tag; and determining whether to execute a safety action based at least in part on the location of the tag.

2. The method of claim 1, further comprising calibrating the one more anchors in the system, wherein the one or more anchors are positioned in a hoistway of an elevator system, wherein the one or more anchors monitor at least one of an area above an elevator car or an elevator pit.

3. The method of claim 2, wherein calibrating the one or more anchors comprises configuring the master anchor to communicate with the other anchors and a controller, wherein the master anchor is selected based on at least one of a static assignment or a dynamic assignment, wherein the dynamic assignment is based on at least one of a battery life, functionality, or power ON sequence of the one or more anchors.

4. The method of claim 3, wherein the safety action includes at least one of disabling an elevator car, reducing elevator car speed, or restricting access to one or more floors.

5. The method of claim 1 further comprising transmitting an alarm to at least one of a user device or the system.

6. The method of claim 1, wherein the tag is an ultra-wide band (UWB) RF tag.

7. The method of claim 1, wherein:

the tag is within a hoistway; and the method further comprises executing a safety action on an elevator car that is not within the hoistway based at least in part on the location of the tag.

8. The method of claim 2, further comprising performing a first safety action based at least in part on the detection of the tag in a first sub-zone of the area of an elevator car.

9. The method of claim 1, further comprising performing a second safety action based at least in part on the detection of the tag in a second sub-zone of the area of the elevator car, wherein the first safety action is different from the second safety action.

10. The method of claim 9, further comprising detecting multiple tags having a unique identifier.

11. A system for detecting a tag, the system comprising:

a controller configured to communicate with one or more anchors;

wherein the one or more anchors comprise a master anchor and other anchors;

wherein the master anchor is operable to collect data from the other anchors;

a tag configured to transmit a signal, wherein the signal includes an identifier and location information;

wherein the one or more anchors are configured to detect the signal from the tag;

wherein the controller is configured to determine whether to execute a safety action responsive to receiving a signal from the master anchor based on the one or more anchors detecting the signal from the tag.

12. The system of claim 11, wherein the controller is configured to perform trilateration of signals from a plurality of anchors.

13. The system of claim 12, wherein the tag and the one or more anchors are ultra-wide band (UWB) RF tag.

14. The system of claim 11, wherein the one or more anchors are positioned in a hoistway of an elevator system to monitor at least one of an area above an elevator car or an elevator pit.

15. The system of claim 12, wherein one or more anchors are configured to perform a calibration which comprises configuring the master anchor to communicate with the other anchors and the controller, wherein the master anchor is selected based on at least one of a static assignment or a dynamic assignment, where the dynamic assignment is based on at least one of a battery life, functionality, or power ON sequence of the one or more anchors.

16. The system of claim 15, wherein the safety action includes at least one of disabling an elevator car, reducing elevator car speed, or restricting access to one or more floors.

17. The system of claim 11, wherein the controller is configured to transmit an alarm to at least one of a user device or an external system.

18. The system of claim 11, wherein:

the tag is within a hoistway; and the controller is configured to execute a safety action on an elevator car that is not within the hoistway based at least in part on the location of the tag.

19. The system of claim 15, wherein the controller is configured to perform a first safety action based at least in part on the detection of the tag in a first sub-zone of the area of an elevator car, and perform a second safety action based at least in part on the detection of the tag in a second sub-zone of the area of the elevator car, wherein the first safety action is different from the second safety action.

20. The system of claim 19, further comprising a plurality of tags wherein each tag of the plurality of tags comprises a unique identifier.

* * * * *